United States Patent [19]

Young et al.

[11] Patent Number: 4,708,892

[45] Date of Patent: Nov. 24, 1987

[54] ARTIFICIAL FLOWER

[76] Inventors: Elaine L. Young, 97-30 57th Ave., Rego Park, N.Y. 11368; George Spector, 233 Broadway Rm 3815, New York, N.Y. 10007

[21] Appl. No.: 923,590

[22] Filed: Oct. 27, 1986

[51] Int. Cl.[4] ..... A41G 1/00

[52] U.S. Cl. ..... 428/24; 156/61

[58] Field of Search ..... 428/24, 25, 26; 156/61

[56] References Cited

U.S. PATENT DOCUMENTS

| | | | |
|---|---|---|---|
| 1,568,859 | 1/1926 | Rosas | 428/26 |
| 1,757,943 | 5/1930 | Mesa | 428/26 X |
| 2,879,617 | 3/1959 | Popeil | 428/24 X |
| 3,137,610 | 6/1964 | Flynn | 428/24 X |
| 3,452,476 | 7/1969 | Kise | 428/24 X |
| 3,822,171 | 7/1974 | Bouillot | 428/25 |
| 4,082,872 | 4/1978 | Hughes | 428/24 |

*Primary Examiner*—Henry F. Epstein

[57] ABSTRACT

An artificial flower is provided and consists of loops of wire and nylon fabric to make petals, a straight piece of wire to make a stem, an artificial stamen placed within center of the petals, artificial leaves secured to the stem, and florist tape wrapped around the stem and bottom of the cluster of the petals to form a bulb thereto. In a modification the bulb is adjustable and has various twisted petals plugged thereinto.

2 Claims, 2 Drawing Figures

ARTIFICIAL FLOWER

BACKGROUND OF THE INVENTION

The instant invention relates generally to imitation flowers and more specifically it relates to an artifical flower.

Numerous imitation flowers have been provided in prior art that are adapted to be fabricated to simulate real flowers. For example, U.S. Pat. Nos. 1,568,859; 1,757,943 and 3,822,171 all are illustrative of such prior art. While these units may be suitable for the particular purpose to which they address, they would not be as suitable for the purposes of the present invention as heretofore described.

SUMMARY OF THE INVENTION

A primary object of the present invention is to provide an artifical flower that will overcome the shortcomings of the prior art devices.

Another object is to provide an artifical flower in which wire, tape, thread and nylon are used to make the petals, stamen, bulb, leaves and stem.

An additional object is to provide an artifical flower that includes an adjustable bulb so that various petals can be twisted and plugged into the bulb to change the shape of the flower.

A further object is to provide an artifical flower that is simple and easy to use.

A still further object is to provide an artifical flower that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
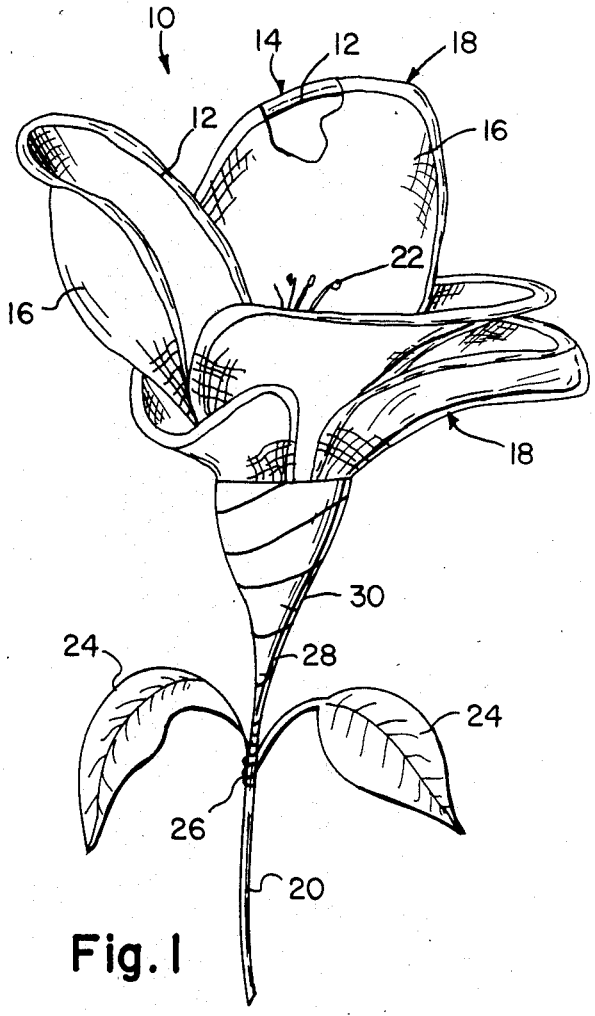
FIG. 1 is a perspective view of the invention with parts broken away.

Turning now descriptively to the drawings, in which similar reference characters denote similar elements throughout the several views, FIG. 1 illustrates an artifical flower 10 that contains a plurality of flexible frames 12 formed from flexible lightweight strand like wires bent over to make loops 14. A plurality of elastic knitted fabric material pieces 16 are each formed from texturized synthetic yarns tautly stretched over each of the loops 14 to cover the loops thus making a plurality of petals 18 in a cluster.

A substantially straight stem 20 is formed from a single flexible lightweight strand like wire. An artifical stamen 22 is placed within center of the petals 18. A plurality of artifical leaves 24 are secured by thread 26 to the stem 20. Florist tape 28 is wrapped around the stem 20 and the bottom of the cluster of the petals 18 to form a bulb 30 thereto.

The frames 12 and the stem 20 are fabricated out of soft pliable metal. The elastic knitted fabric material pieces 16 are fabricated out of nylon. The artifical stamen 22 and the artifical leaves 24 are fabricated out of green plastic.

Figure 2:
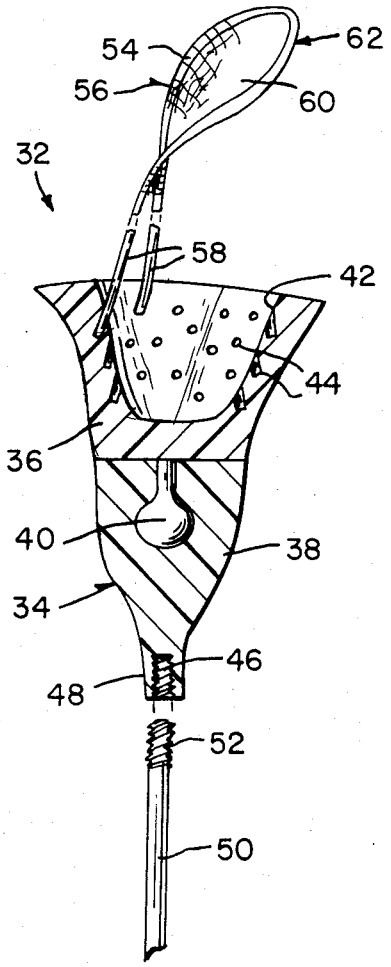
FIG. 2 is a cross sectional view of a modification being an adjustable bulb having various twisted petals plugging thereinto.

FIG. 2 shows a modified artifical flower 32 containing a green plastic bulb 34 that has an upper portion 36 and a lower portion 38 joined together by a ball joint 40. The upper portion 36 can rotate with respect to the lower portion 38. The upper portion 36 has a cavity 42 with a plurality of random placed holes 44 therein. The lower portion 38 has a threaded aperture 46 at bottom end 48 thereof. A substantially straight green plastic stem 50 has a threaded end 52 so as to be received within the threaded aperture 46 in the lower portion 38 of the bulb 34. A plurality of flexible frames 54 are provided. Each frame is formed from a flexible lightweight strand like wire bent over to make a loop 56 and has two ends 58.

A plurality of elastic knitted fabric material pieces 60 are also provided. Each piece 60 is formed from textured synthetic yarns tautly stretched over each loop 56 to cover the loop, thus making a plurality of petals 62 in which only one petal is shown. Each of the frames 54 can plug in the two ends 58 into any two of the holes 44 within the cavity 42 of the upper portion 36 of the bulb 34. Each of the petals 62 can be twisted into different shapes and the upper portion 36 of the bulb 34 can be turned for changing appearance of the artifical flower 32.

The frames 54 are fabricated out of soft pliable metal. The elastic knitted fabric material pieces 60 are fabricated out of nylon.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An artificial flower comprising:

(a) a bulb having an upper cup and lower support with contiguous contoured surfaces shaped to simulate a bulb and connected by means whereby said upper cup can rotate with respect to said lower support, said upper cup having a cavity with a plurality of randomly placed holes therein;

(b) a stem having an end adapted to be connected to said bulb;

(c) a plurality of flexible frames, each said frame formed from a flexible lightweight strand like material bent over to make a loop and having two spaced ends; and (d) a plurality of elastic knitted fabric material pieces, each said piece formed from textured synthetic yarns tautly stretched over each said loop to cover said loop except for said ends thus making a plurality of petals, said loop ends can be plugged into any two of said holes within said cavity of said upper portion of said bulb so that each of said petals can be twisted into different shapes and the upper portion of said bulb can be turned for changing the appearance of said artificial flower.

2. A flower as in claim 1, wherein said means comprise a ball and socket connection and wherein said stem is removeable from said bulb.

* * * * *